US006543737B2

(12) United States Patent
Decker et al.

(10) Patent No.: US 6,543,737 B2
(45) Date of Patent: Apr. 8, 2003

(54) TISSUE BOX HOLDER

(76) Inventors: Clayton O. Decker, 1965 S. Parfet Dr., Lakewood, CO (US) 80227; James M. Magee, 918 Mercury Cir., Littleton, CO (US) 80124

( * ) Notice: Subject to any disclaimer, the term of this patent is extended or adjusted under 35 U.S.C. 154(b) by 0 days.

(21) Appl. No.: 09/918,753

(22) Filed: Jul. 30, 2001

(65) Prior Publication Data

US 2002/0113187 A1 Aug. 22, 2002

Related U.S. Application Data

(60) Provisional application No. 60/269,705, filed on Feb. 20, 2001.

(51) Int. Cl.[7] ..... A47G 1/10

(52) U.S. Cl. ..... 248/316.1; 248/316.7; 248/905

(58) Field of Search ..... 248/905, 690, 248/215, 316.1, 316.4, 316.7, 339

(56) References Cited

U.S. PATENT DOCUMENTS 2,263,956 A * 11/1941 Russell ..... 248/311
3,089,597 A * 5/1963 Kaplan ..... 211/88
4,177,910 A * 12/1979 Gangl ..... 224/252
5,368,267 A * 11/1994 Howard ..... 248/231.4
5,415,371 A * 5/1995 Kirchner ..... 248/316.4
5,738,319 A * 4/1998 Grassi ..... 248/215
5,884,240 A * 3/1999 Edgar et al. ..... 702/157
6,073,899 A * 6/2000 Omrani ..... 248/311.2
6,302,280 B1 * 10/2001 Bermes ..... 211/70.6

* cited by examiner

*Primary Examiner*—Leslie A. Braun
*Assistant Examiner*—A. Joseph Wujciak, III
(74) *Attorney, Agent, or Firm*—Thomas W. Hanson

(57) ABSTRACT

A holding device for temporarily attaching a facial tissue box or similar container to a supporting structure such as glove box door, sun visor, window, bed railing or headboard, or similar. The device is removably attachable to both the box and the supporting structure. Two laterally projecting arms grip the box while a clip attaches to the structure. The arms may comprise hooks, points or other features designed to enhance their grip on a paperboard, or similar, box. These features may optionally penetrate, crimp, or depress the side of the container. If desired, one or both of the arms may be adjustable to accommodate a range of box widths and/or depths.

11 Claims, 10 Drawing Sheets

TISSUE BOX HOLDER

CROSS-REFERENCE TO RELATED APPLICATIONS

This application claims the benefit of U.S. Provisional Application Ser. No. 60/269,705 filed Feb. 20, 2001.

STATEMENT REGARDING FEDERALLY SPONSORED RESEARCH OR DEVELOPMENT

Not Applicable

BACKGROUND OF THE INVENTION

1. Field of the Invention

The present invention relates to the field of removable holders for containers and specifically to holders for facial tissue boxes or the like. Even more specifically it relates to such containers intended to be removably attached a supporting structure such as a glove box door, bed side rail or similar.

2. Background Information

The need to have facial tissues available for hygienic purposes is well known. This need is even greater for persons who suffer from allergies or other medical conditions. They may need immediate access to tissues while driving, in the workplace, or while in bed. Where a person is disabled or convalescing, it is desirable to make the tissues available within the immediate vicinity so that the person can reach them without moving.

A variety of holders for tissues have been created including weighted holders, holders that attach with hook and loop fastener, and others. Many of these are box designs which fully enclose the tissue box. While usable, they suffer from various drawbacks.

Weighted holders require a substantially horizontal surface to support the holder. Unless the surface has a high friction surface, the holder may slide on the surface, especially in a car which accelerates, decelerates, and corners. This surface may not be within reach of the user. Hook and loop attachment is more convenient, but typically require adhesive attachment of one part of the fastener to a surface. Not all surfaces are suitable and the adhesive may mar or disfigure the surface.

It would be preferable if the holder would temporarily attach to a nearby structure and could then be removed or repositioned as desired. In a car, this might be a glove box door or sun visor. In the workplace, this might be a shelf, toolbox, or railing. For those convalescing, it might be desirable to attach the tissue box to a bed railing or headboard, within reach.

There are products other than facial tissues to which such a holder would be applicable. Paper towels, napkins, rubber gloves, and ear plugs are all available in boxes or dispensers and in any number of circumstances it would be desirable to make them available in close proximity to a user or to a particular location. Examples include placing paper towels or earplugs near machine tools and napkins near a cafeteria line. Each of these products is available in a variety of sizes of boxes. As such, it would be preferable that the holder be adaptable to a range of sizes.

There is a need for a detachable holder for a box of tissues or other product which will removably mount to a supporting structure. Preferably the holder should accommodate a range of box sizes. Also preferably, it should the adapted to attach to a range of supporting structures, including relatively thin panels, such as a glove box door or the side of a tool box and relatively thick structures such a railings. Ideally the holder will be adjustable in at least one dimension to adapt to various box sizes.

BRIEF SUMMARY OF THE INVENTION

The present invention is directed to a device for attaching a facial tissue box, or similar container, to a supporting structure. The device uses a clip which is shaped to grip either a thin or a thick structure and a pair of arms to grip the box. The spacing between the arms closely approximates the width of the box to be held, holding the box in place in one dimension. At least one of the arms has a means for gripping the box, limiting its movement in a second dimension.

According to the invention one of the arms may be adjustable relative to he position of the other, to adapt to various size boxes.

According to an aspect of the invention both arms may be provided with a means for gripping the box.

According to another aspect of the invention the means for gripping may embrace the box by enclosing three sides (in combination with the spine of the device); by penetrating the side of the container; by crimping a corner of the container; or by bearing against the side of the container, with or without a point to increase the grip.

Further in accordance with the invention there may be provided a grip to make it easier for the user to grasp the device and pull it off of the supporting structure.

The advantages of such an apparatus are that a box of facial tissues, or other product, can be removably mounted to any convenient supporting structure, placing them within easy reach of the user.

The above and other features and advantages of the present invention will become more clear from the detailed description of a specific illustrative embodiment thereof, presented below in conjunction with the accompanying drawings.

DETAILED DESCRIPTION OF THE INVENTION

Figure 1:
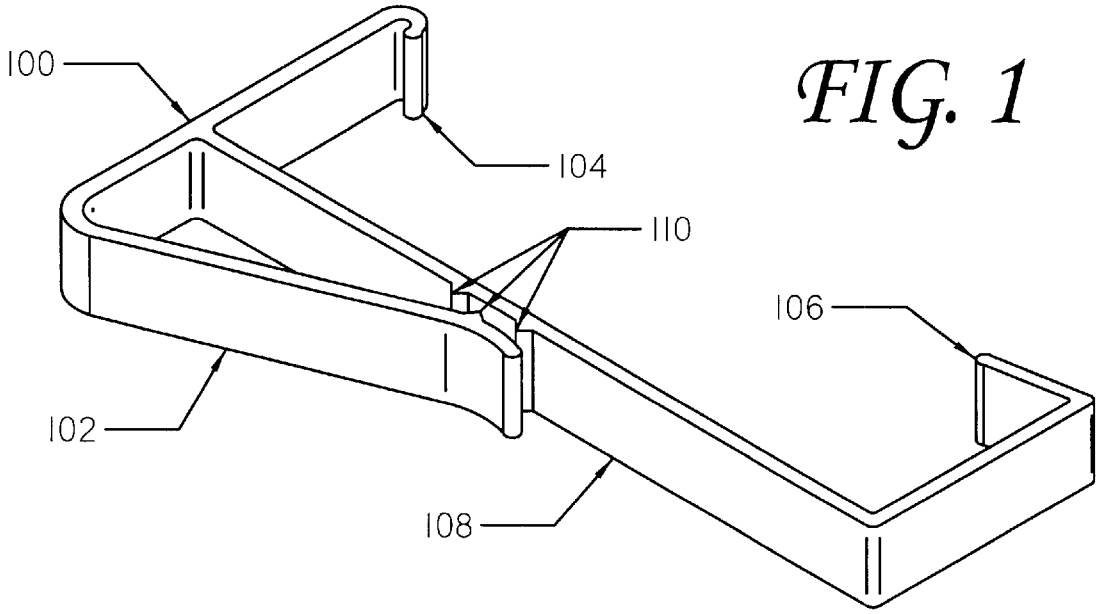
FIG. 1 is a perspective view of the first preferred embodiment of the device lying flat.
Figure 2:
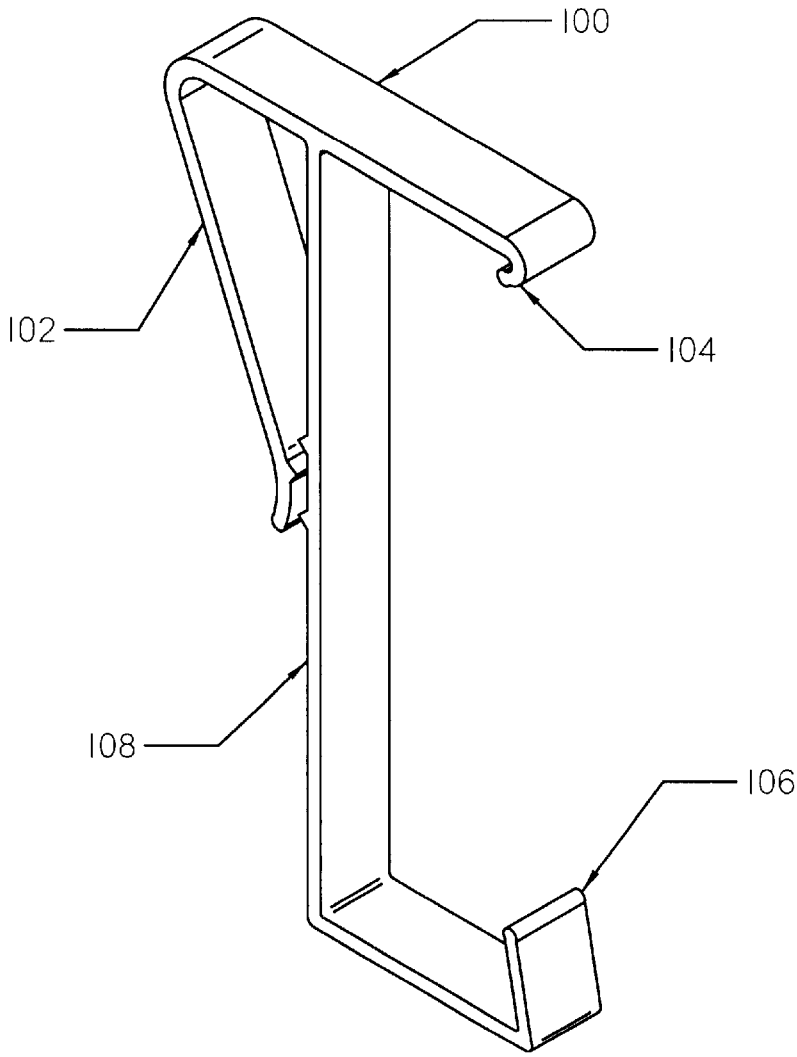
FIG. 2 is a perspective view of the first preferred embodiment of the device in it's normal use position.
Figure 3:
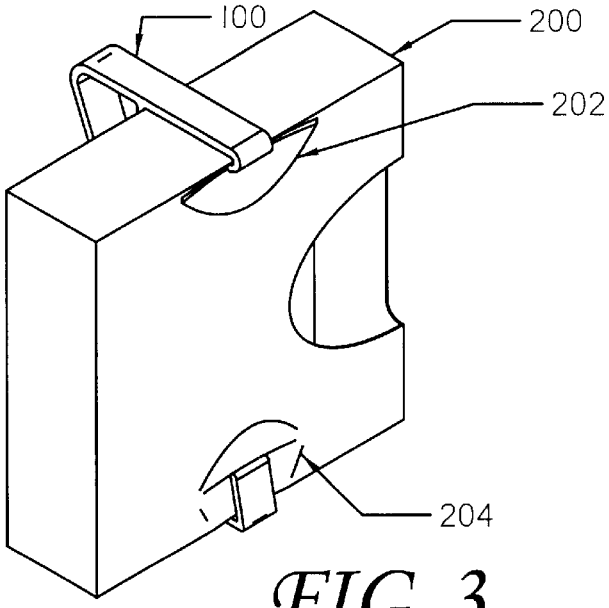
FIG. 3 illustrates the first preferred embodiment in position attached to a box.
Figure 6:
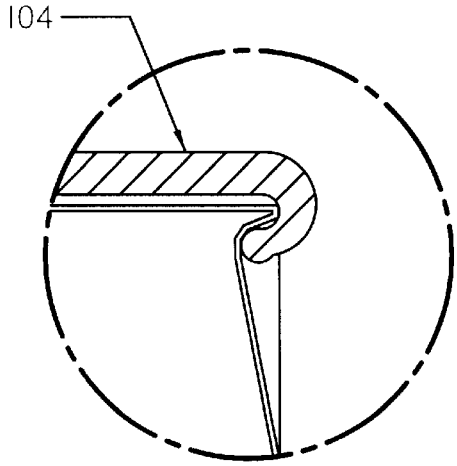
FIG. 6 is a detailed view of the hook attached to and crimping the corner of a box.
Figure 4:
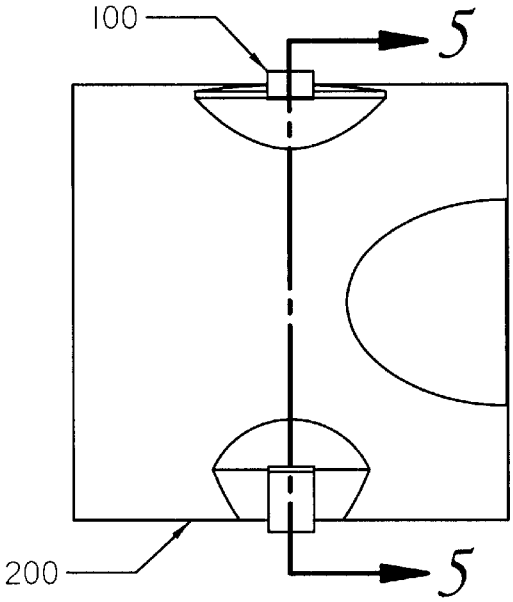
FIG. 4 is a front view corresponding to FIG. 3.
Figure 5:
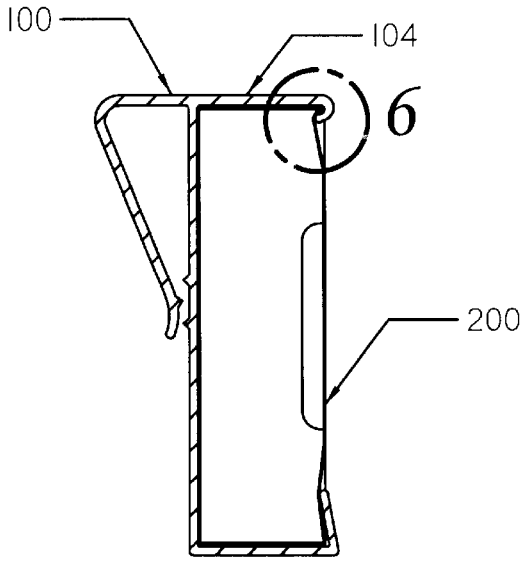
FIG. 5 is a cross section through the configuration of FIG. 4

The following discussion focuses on the preferred embodiments of the inventive holder, a single piece embodiment adapted to a single size of facial tissue box and an adjustable embodiment adaptable to a range of box sizes. It also presents several alternative embodiments for holding tissue boxes. However, as will be recognized by those skilled in the art, the disclosed apparatus is applicable to a wide variety of situations in which a removable retainer or holder for a box or other container is desired. For larger containers, multiple instances of the present holder could be used for added security.

Glossary

The following is a brief glossary of terms used herein. The supplied definitions are applicable throughout this specification and the claims unless the term is clearly used in another manner.

Arm—either of the laterally extending portions which engage or support the box.

Box—in the preferred embodiments this is a facial tissue box. However, any box or similar container, regardless of contents or shape, is considered equivalent.

Clip—generally that portion used to attach the inventive device to a supporting structure.

Spine—generally that portion which spans the width or height of the box and to which the other elements attach. Note that one element could attach directly to another, rather than to the spine, without departing from the principles of the invention.

Preferred Embodiments

The disclosed invention is described below with reference to the accompanying figures in which like reference numbers designate like parts. Generally, numbers in the 200's refer to prior art elements or elements in the surrounding environment while numbers in the 100's refer to elements of the invention.

First Preferred Embodiment

FIGS. 1–6 illustrate a first preferred embodiment of the present invention which is non-adjustable and adapted to fit a single size of tissue box. Spine, 108, is sized to closely match the width of the box to be held and provides an attaching point for the remaining elements. Clip, 102, attaches the holder to a supporting structure, such as a glove box door, window, bed rail or any other structure. Optional teeth, 110, increase the holding power of the clip. Upper arm, 104, extends laterally away from the spine and embraces and retains one side of the box. It preferably ends in a relatively small radius hook positioned to grip the corner of the box. Lower arm, 106, similarly extends laterally, embraces and retains the opposite side of the box. It preferably ends in an angled portion which extends for at least a short distance along the face of the box opposite the spine of the holder. Preferably, this angled portion angles back towards the spine of the holder, applying a biasing force to the box, urging it against the spine of the holder. Clearly the ends terminating the two arms could be interchanged or either type could be used on both arms. Note that while the arms in the preferred embodiment extend away from the spine at substantially right angles, this is not a requirement of the invention. Nor is it a requirement that they be straight. Curved arms would also adapt the device to holding containers which are cylindrical or otherwise curved.

FIGS. 3–6 illustrate the inventive holder attached to a tissue box. Upper arm, 104, grips the upper corner of the box. Preferably the hook is positioned so that the inner radius closely receives the side of the box and the end of the hook presses into the face of the box forming a depression, 202, in the face. In this manner, the box provides a biasing force as it tries to return to its original shape, which helps retain the box in place relative to the holder. The hook shape is advantageous in that it actually strengthens the corner of the box by crimping the corner of the box. That portion of the face immediately adjacent the corner is rolled back toward the side of the box, effectively doubling the thickness of material at that point, see FIG. 6. Lower arm, 106, grips the lower side of the box and bears against the face of the box. Where the angle of the lower arm end is sufficient, the face of the box will be depressed, 204, in a manner similar to that for the upper arm, but would not crimp the corner.

The holder is typically installed by hooking the upper arm on one corner of the box and rotating the holder into position spanning the box as shown. The lower arm is flexed away from the box to provide clearance and then allowed to relax into the position shown. The clip is then attached to any desired supporting structure.

Alternative Embodiments of First Preferred Embodiment

The following alternative embodiments offer various advantages in structure or function without departing from the principles of the invention.

Figure 7:
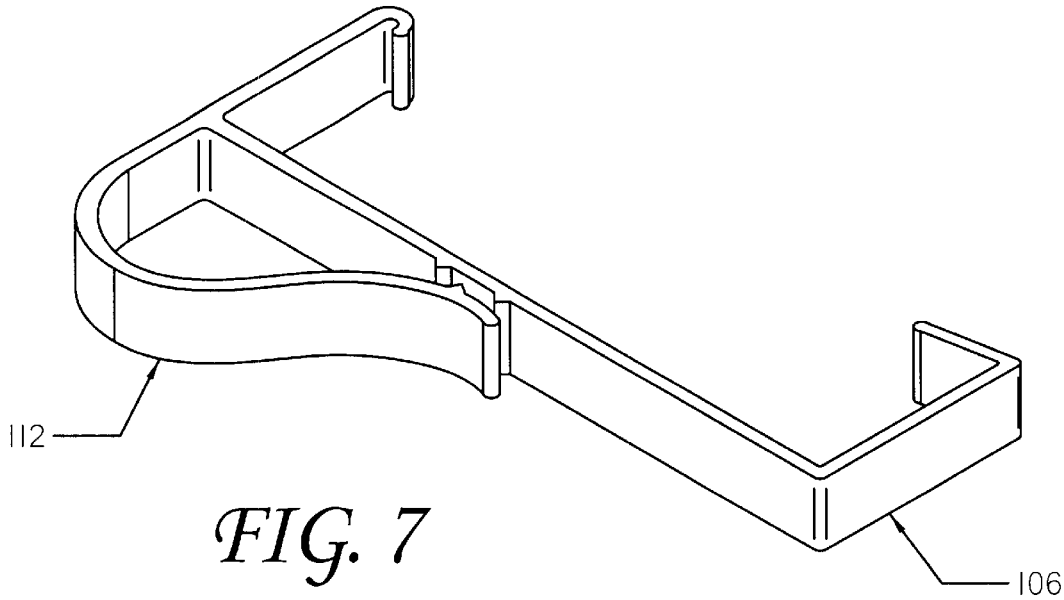
FIG. 7 illustrates an alternative embodiment with an enlarged clip.

FIG. 7 illustrates an embodiment of the invention which incorporates a larger, curved clip, 112. This shape is more optimal for attachment to larger supporting structures such as the rail on a hospital bed or a piece of equipment near where tissues are needed.

Figure 8:
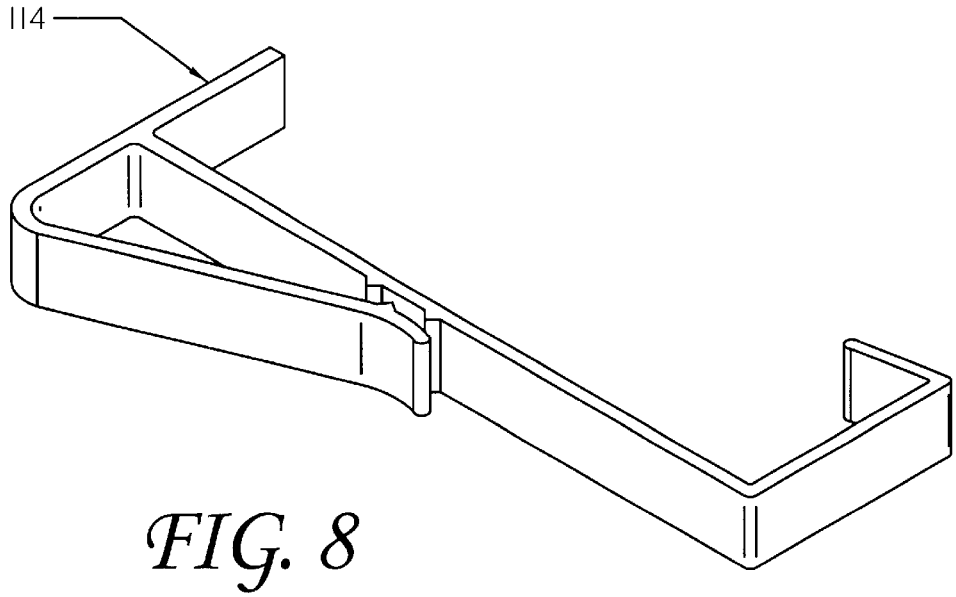
FIG. 8 illustrates an alternative embodiment with a truncated upper arm.

The embodiment of FIG. 8 uses a straight upper arm, 114. This allows the use of the holder with boxes of varying depth, as the length of arm need not closely match the depth of the box. This works well in combination with the lower arm illustrated in FIG. 9 or lower arm, 106, FIG. 1, but having a more steeply angled end. It does however permit angular movement of the box in a plane parallel to that of the sides of the holder because the side of the box adjacent the upper arm is free to move away from the spine of the holder, unless the upper arm is made very rigid.

Figure 9:
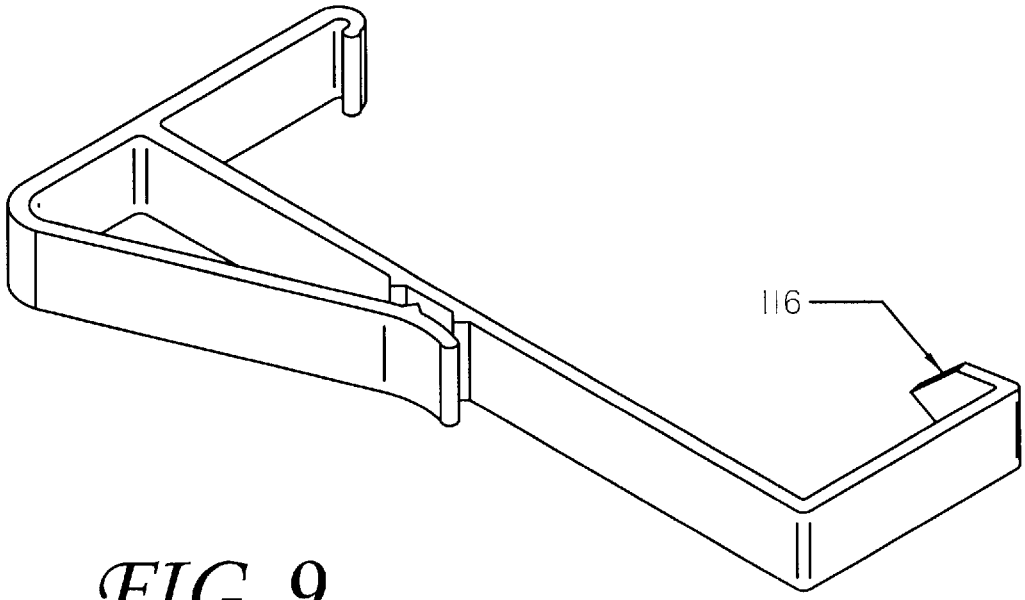
FIG. 9 illustrates an alternative embodiment with a pointed lower arm.

The embodiment of FIG. 9 incorporates a pointed lower arm. While the pointed tip can function as in the above preferred embodiment, by enclosing the box, it is also adapted to contact the side of the box. The point may either press against the side of the box or penetrate the box side. If desired, the point could be barbed to assist retention within the hole formed in the side of the box.

Clearly, the arm configurations of FIGS. 8 & 9 can each be used on either arm. The combination of one straight arm, like that of FIG. 8 and one pointed arm, as in FIG. 9, would allow the holder to be used with any depth of box. The only critical dimension to the holder is then the length of the spine, which needs to match the width of the box being held. This is a relatively minor limitation since the box sizes are substantially standardized.

Figure 10:
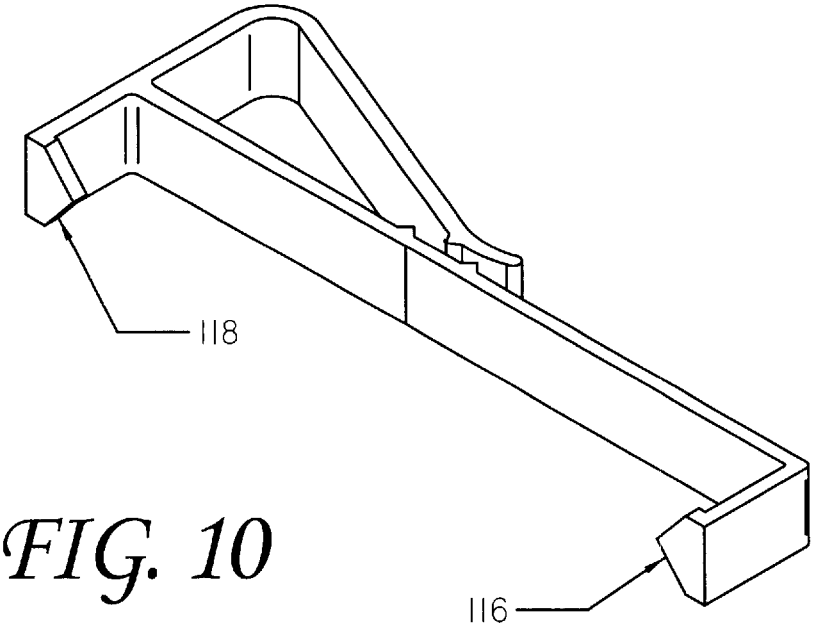
FIG. 10 illustrates an alternative embodiment with pointed upper and lower arms.

FIG. 10 illustrates an alternative embodiment in which both upper and lower arms have pointed ends, 116 and 118. As above, this point may either contact or penetrate the side of a tissue box. In addition, the arms are shorter for increased strength more compact shape. Since the arms do not need to encompass the side of the box, there is no need for additional length. This configuration readily attaches to boxes of a wide range of depth.

Figure 11:
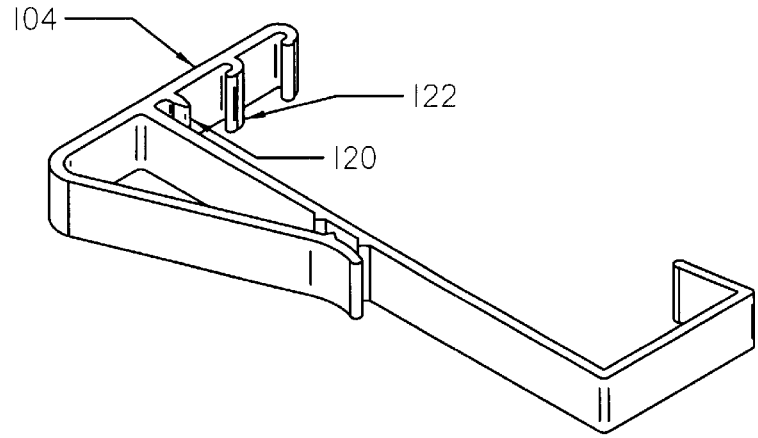
FIG. 11 illustrates an alternative embodiment with multiple hooks, or gripping means, on the upper arm.

The upper arm, 104, of the embodiment of FIG. 11 incorporates multiple hooks, allowing it to connect to multiple depths of boxes. The inner-most hook, 120, is adapted to grip the corner of a box, immediately adjacent the spine. The middle hook, 122, is adapted to grip the edge of the opening in the side of the box through which tissues are extracted. The outer hook, is the same as that in the preferred embodiment above and can grip either the corner of a box, or the edge of an opening in a box.

Figure 12:
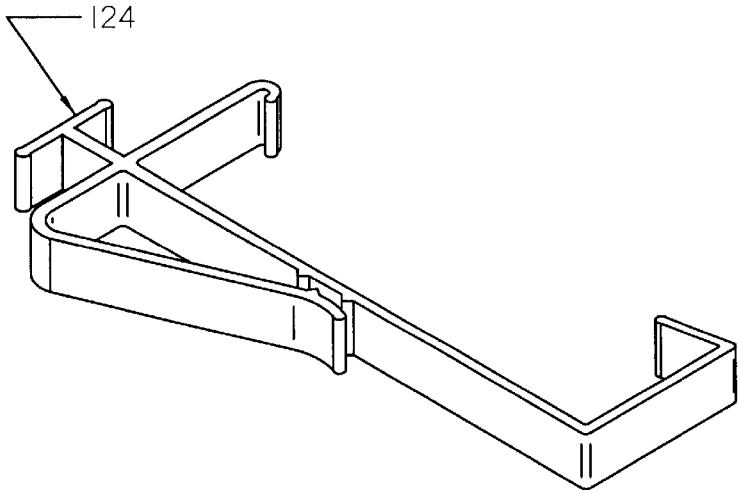
FIG. 12 illustrates an alternative embodiment with a T-shaped grip.
Figure 13:
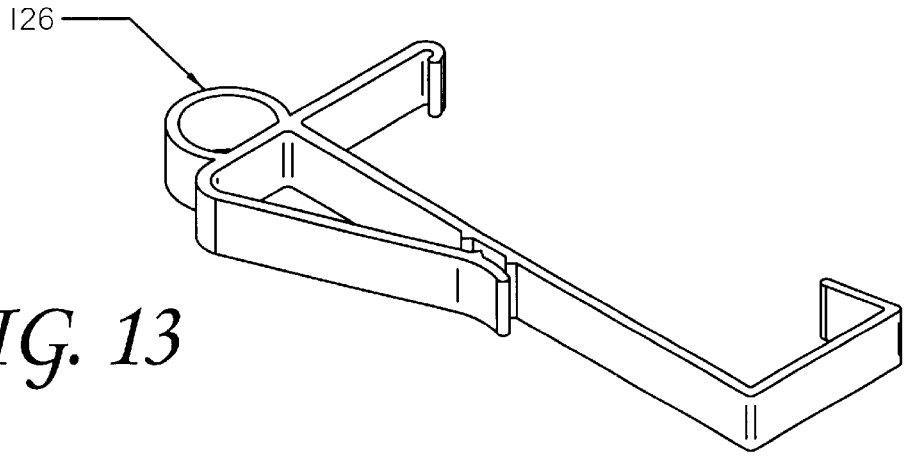
FIG. 13 illustrates an alternative embodiment with a looped grip.

The embodiments of FIGS. 12 and 13 incorporate a grip to facilitate removal of the holder from the structure to which it is attached. While probably not necessary when used with a relatively thin structure, such as a glove box door, it can be very helpful with a larger structure such as a hand rail or pipe, which may require significant effort to remove the holder. This is especially important where the holder is used by a disabled or convalescent user. FIG. 12 illustrates a T-shaped grip, 124, and FIG. 13 illustrates a circular, or loop, grip, 126. Clearly other shapes are equally applicable.

Second Preferred Embodiment

Figure 14:
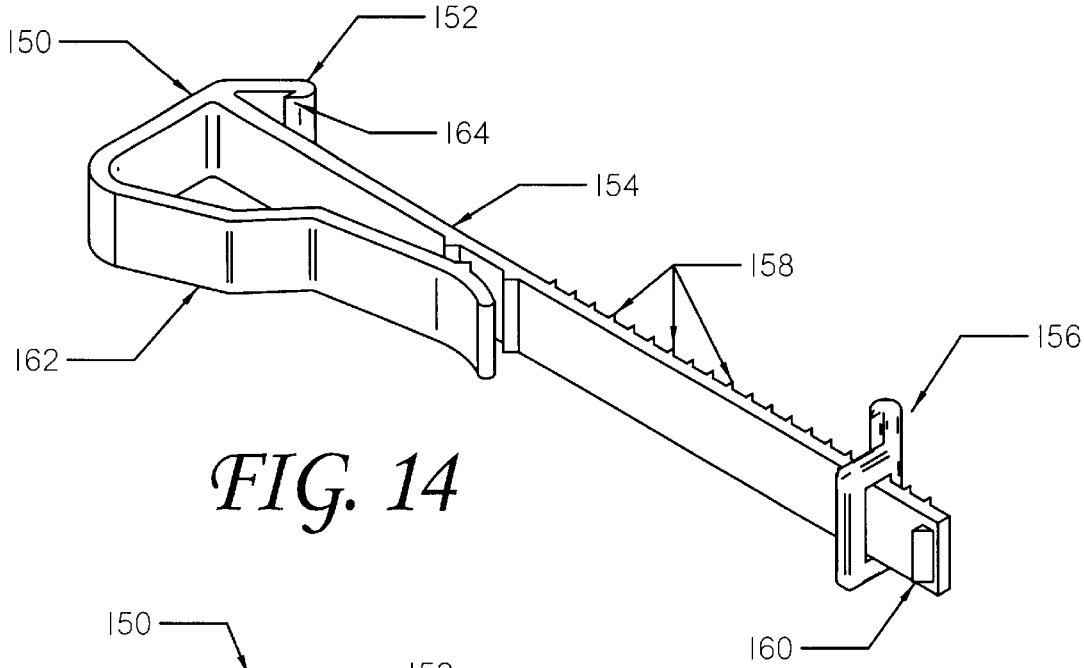
FIG. 14 is a perspective view of the second preferred embodiment of the device.
Figure 16:
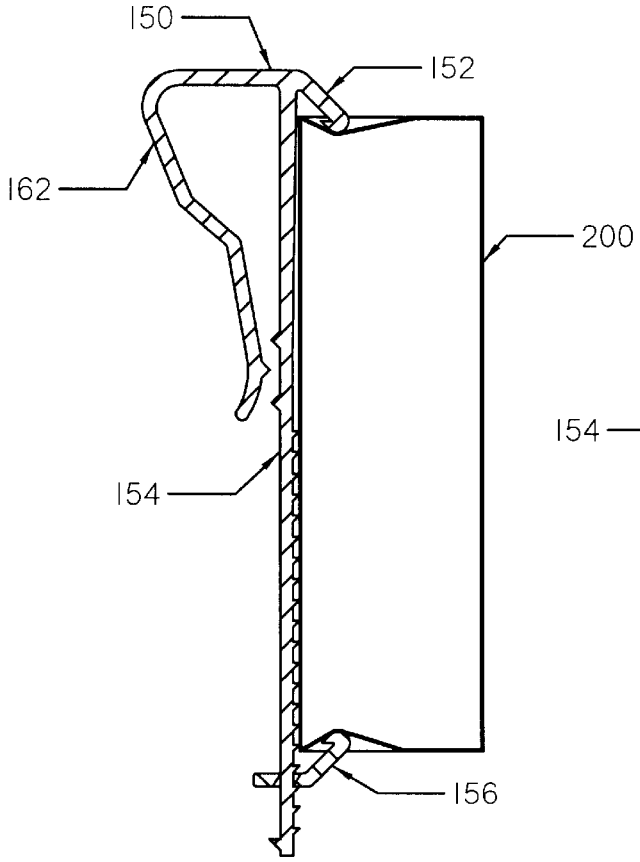
FIG. 16 is a cross section showing the second preferred embodiment attached to a box.
Figure 15:
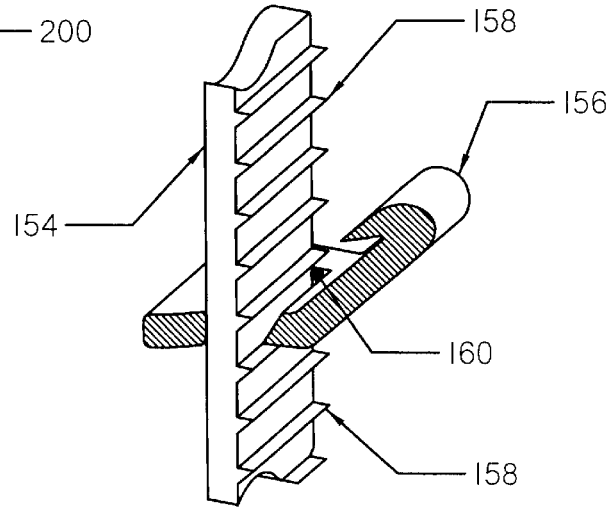
FIG. 15 is a detailed cutaway view of the adjustable lower arm.

A second preferred embodiment of the present inventive holder is illustrated in FIGS. 14–16. This embodiment differs from the first preferred embodiment primarily in that it is adjustable for different box widths. Further, the upper and lower arms are shortened and adapted to grip the side of the box in a manner similar to that of the embodiment of FIG. 10, discussed above. In the extreme, the upper and lower arms could be considered to have been eliminated and replaced by hooks or other gripping means. Other than that, the overall structure and function is the same.

Spine, 154, serves as the attaching point for the other elements including clip, 162, upper arm, 152, and lower arm, 156. The upper arm is shortened relative to the first embodiment and angles inward to press against the side of the box. It preferably ends in a hook, 164, angled back toward the spine to further help in retaining the holder in position relative to the box. Preferably, the inner face of the hook is perpendicular to the spine of the holder for optimum grip, but other angles could be used. As in the first preferred embodiment, the action of the arm and hook crimps the corner of the box.

The lower arm, 156, has a shape similar to that of the upper arm, angled inward and then preferably hooked back toward the spine. As with hook, 164, the inner face is preferably perpendicular to the spine, but could vary. It differs in that it is adjustable along at least a portion of the spine to adapt the holder to boxes of various widths. The spine is toothed, with the teeth arranged to engage the lower arm and hold it in position. As shown in FIG. 15, the lower arm has an opening, 160, through which the spine passes. Preferably, the slot is angled so that when the arm is tilted inward, the opening is sufficiently wide to pass over the teeth and when the arm is tilted outward, the opening is the width of the spine itself and the lower face of the arm rests against the shoulder of a tooth. Clearly notches rather than teeth could be used as could any other of the well know techniques for providing adjustment of this type. Alternatively, the spine could be smooth and the arm adapted to grip the spine when forced outward in a manner similar to the sliding stop on a screen door closer or catch on a caulking gun.

As shown in FIG. 16, the upper, 152, and lower, 156, arms are adapted to grip the corner of a box, 200, by at least somewhat depressing the side of the box immediately adjacent the corner. The hook portion of the arm then engages the surface of the box to further increase the hold on the box. This approach allows the holder to be attached to any depth of box. Where the dimensions of the hook portions are sufficiently small, they provide a crimping action similar to that described above with respect to the first preferred embodiment.

Optional stop, 160, retains the lower arm on the spine so that it does not become lost. It is preferably angled inward so that the arm is easy to insert onto the spine, but difficult to remove. Clearly, the stop and/or the teeth could be moved to the opposite side of the spine, or even positioned on the edges of the spine if desired.

The clip, 162, illustrated on this embodiment is an alternate approach to those discussed above with respect to the first preferred embodiment. The large space near the top is adapted to fit over large structures such as a pipe or railing and the lower portion of the clip is adapted to fit a thinner structure such as glove box door, draw front, etc.

Alternative Embodiments of Second Preferred Embodiment

The following alternative embodiments offer various advantages in structure or function without departing from the principles of the invention.

Figure 17:
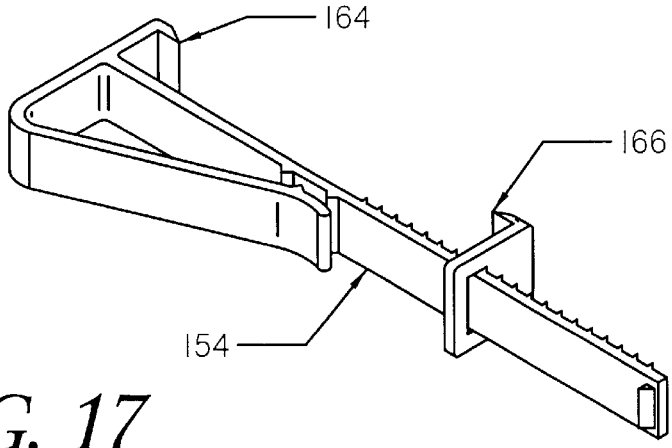
FIG. 17 illustrates an alternative embodiment with straight, hooked upper and lower arms.

The embodiment of FIG. 17 is similar to that of the second preferred embodiment differs in the shape of the upper, 164, and lower, 166, arms. Rather than angling inward, they are substantially perpendicular to the spine with hooks on the end adapted to engage the side of the box.

Figure 19A:
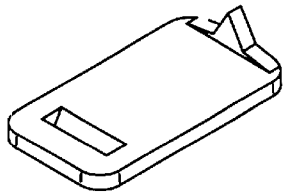
FIGS. 19A–C illustrate candidate configurations for a lower arm for the embodiment of FIG. 18.
Figure 18:
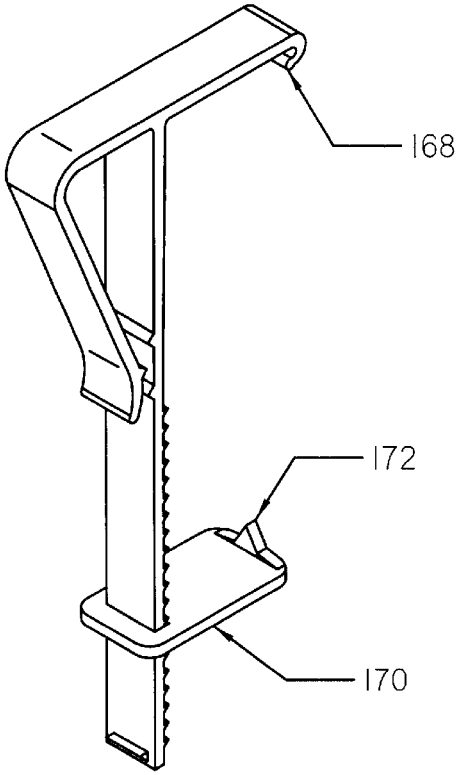
FIG. 18 illustrates an alternative embodiment using an upper arms from the first preferred embodiment and a longer lower arm.
Figure 19B:
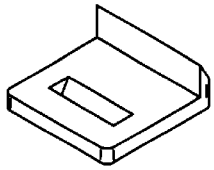
Figure 19C:
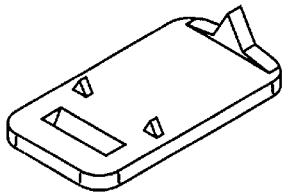

FIG. 18 illustrates an embodiment which uses an upper arm, 168, of the same design as in the first preferred embodiment and a sliding lower arm, 170, similar to that of the second preferred embodiment. This lower arm is somewhat longer and is intended to both support the corner of the box, near the spine, and to grip the side of the box at the distal end using point, 172. Any of a variety of arm designs may be used including those illustrated in FIGS. 19A–C. Note that the arm configuration of FIG. 19C has points both at the distal end, to engage the side of the box, and near the spine, to engage the corner of the box.

Figure 20:
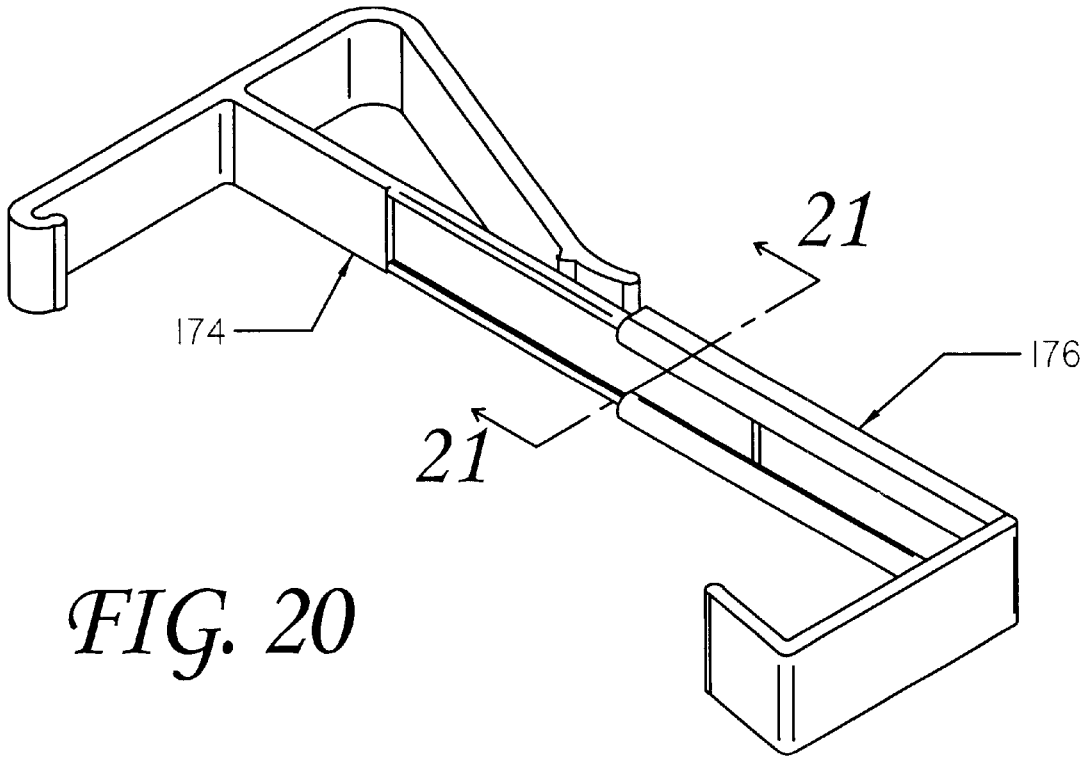
FIG. 20 illustrates an alternative embodiment in which two halve of the devices adjust rather than having a sliding lower arm.
Figure 21:
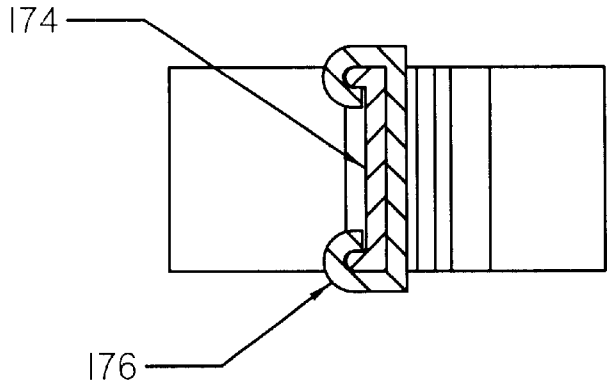
FIG. 21 is a cross section through the embodiment of FIG. 20 showing the mating of the two halves.

The embodiments of FIGS. 20–23 adapt the design of the second preferred embodiment by using a two-piece spine to provide adjustment rather than moving the lower arm relative to the spine. In the embodiment of FIGS. 20 and 21, the upper portion, 174, of the holder is slideably received in the lower portion, 176, of the holder. Preferably the lower portion forms a substantially C-shaped cavity which closely receives the spine of the upper portion. This design is similar to that used for telescoping curtain rods and the like. Other techniques well known in the field for providing a telescoping fit would also be applicable. Clearly, the male/female relationship of the upper and lower portions could be reversed. Teeth or serrations could be added to increase the resistance to the relative movement of the upper and lower portions.

Figure 22:
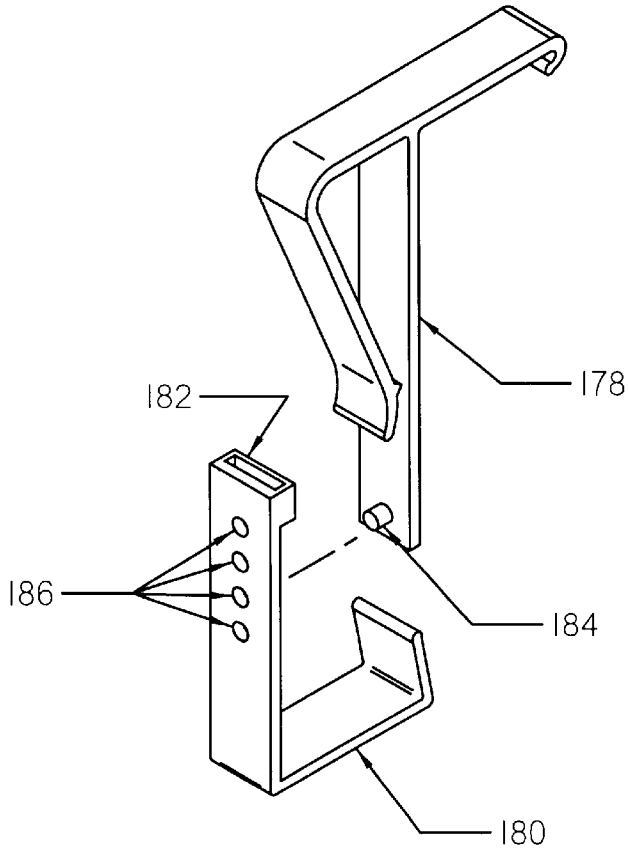
FIG. 22 is an exploded perspective view of an alternative embodiment in which a pin and matching holes are used to provide adjustment.
Figure 23:
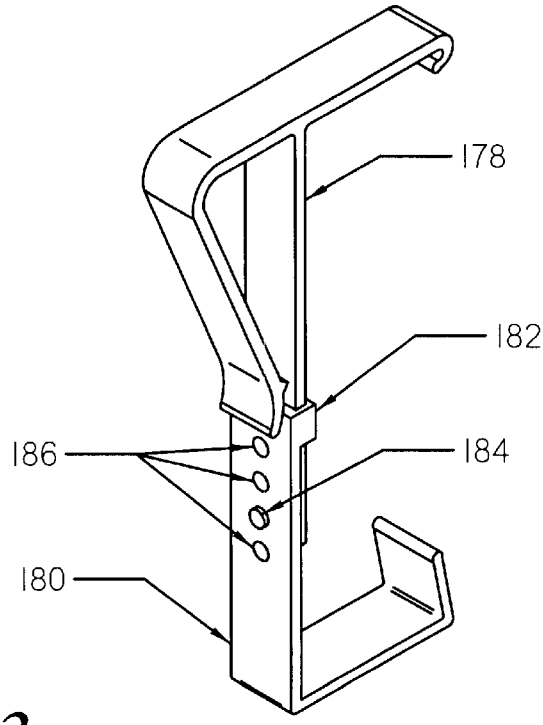
FIG. 23 is a perspective view of the embodiment of FIG. 22 assembled.

The alternative embodiment of FIGS. 22 and 23 utilizes a sliding collar, 182, which encloses the spine for alignment while pin, 184, engages one of the holes, 186, to fix the relative longitudinal position of the two portions of the holder. Clearly, the pins and holes could be switched to the opposite parts.

Figure 24:
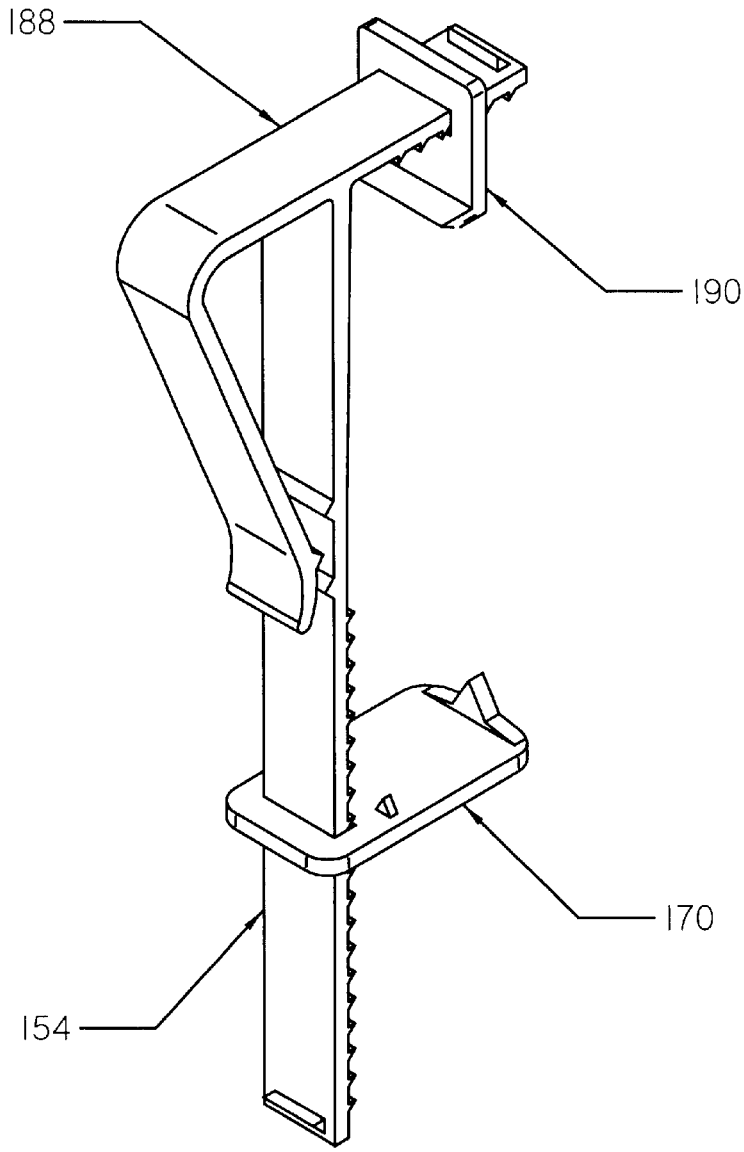
FIG. 24 illustrates an alternative embodiment which is adjustable in two dimensions.

FIG. 24 illustrates an embodiment that extends the adaptability of the embodiment of FIG. 18 by also incorporating an adjustable cross-piece. The upper arm, 188 is toothed in the same manner as the spine, 154, and uses a movable tab, 190, similar to the adjustable lower arm, 170. A variety of forms of tabs/arms can be used on the cross arm including those shown in FIGS. 19A–C.

While the preferred form of the invention has been disclosed above, alternative methods of practicing the invention are readily apparent to the skilled practitioner. The above description of the preferred embodiment is intended to be illustrative only and not to limit the scope of the invention.

What is claimed is:

1. A holding device for removably attaching a container to a supporting structure, said device comprising:

(a) a spine;

(b) an attaching clip connected to said spine;

(c) spaced apart first and second arms connected to and extending laterally away from said spine, defining therebetween a space for receiving the container, whereby linear movement of the container relative to said device in a first plane is substantially eliminated;

(d) said first of said arms comprising a means for gripping the container which further restrains movement of at least a portion of the container in a second plane, whereby linear movement of the container relative to said device in said second plane is substantially eliminated; and wherein said first of said arms is adjustable along the length of said spine.

2. The holding device of claim 1 wherein said adjustable arm comprises a portion aligned with and slideably enclosing said spine.

3. The holding device of claim 1 further comprising a means for gripping connected to and adjustable along the second of said arms.

4. A holding device for removably attaching a container to a supporting structure, said device comprising:

(a) a spine;

(b) an attaching clip connected to said spine;

(c) a first fixed arm connected to and extending laterally away from said spine, said arm comprising a means for gripping the container;

(d) a second, movable arm connected to and extending laterally away from said spine, said arm being adjustable along at least a portion of said spine and comprising a means for gripping the container.

5. The holding device of claim 4 wherein a first of said means for gripping is adapted to bear against the container and apply a biasing force urging the container against a portion of said holding device.

6. The holding device of claim 5 wherein said first gripping means comprises plural points adapted to bear against the container at more than one distance from said spine.

7. The holding device of claim 4 wherein a first of said means for gripping is adapted to crimp a corner of the container.

8. The holding device of claim 4 wherein said first arm's gripping means is adjustable along said arm.

9. A holding device for removably attaching a container to a supporting structure, said device comprising:

(a) a spine;

(b) an attaching clip connected to said spine;

(c) a first means for gripping the container connected said spine;

(d) a second means for gripping the container connected to and adjustable along at least a portion of said spine.

10. The holding device of claim 9 wherein at least one of said means for gripping comprises a hook angled inward towards said spine.

11. The holding device of claim 9 wherein first and second means for gripping are each adapted to crimp a different corner of the container.

* * * * *